US011620958B2

(12) United States Patent
Li et al.

(10) Patent No.: US 11,620,958 B2
(45) Date of Patent: Apr. 4, 2023

(54) DISPLAY DEVICE AND CONTROLLING METHOD THEREOF

(71) Applicant: TCL China Star Optoelectronics Technology Co., Ltd., Guangdong (CN)

(72) Inventors: Yan Li, Guangdong (CN); Yu Wu, Guangdong (CN); Xiong Hu, Guangdong (CN); Haoran Li, Guangdong (CN); Tao He, Guangdong (CN); Guangxing Xiao, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 295 days.

(21) Appl. No.: 17/251,896

(22) PCT Filed: Nov. 19, 2020

(86) PCT No.: PCT/CN2020/129940

§ 371 (c)(1),
(2) Date: Dec. 14, 2020

(87) PCT Pub. No.: WO2022/077700

PCT Pub. Date: Apr. 21, 2022

(65) Prior Publication Data

US 2022/0319450 A1 Oct. 6, 2022

(30) Foreign Application Priority Data

Oct. 13, 2020 (CN) ..... 202011091112.4

(51) Int. Cl.
*G09G 3/34* (2006.01)

(52) U.S. Cl.
CPC ..... *G09G 3/3426* (2013.01); *G09G 2310/08* (2013.01); *G09G 2320/0686* (2013.01)

(58) Field of Classification Search
CPC ..... G09G 2320/0646; G09G 2320/0233; G09G 2320/0653; G09G 2320/0673;
(Continued)

(56) References Cited

U.S. PATENT DOCUMENTS

2009/0278869 A1* 11/2009 Oishi ..... G09G 3/2025 345/691
2012/0169792 A1* 7/2012 Yamashita ..... G02F 1/1336 345/690

(Continued)

FOREIGN PATENT DOCUMENTS

CN 101369407 2/2009
CN 101370339 2/2009

(Continued)

OTHER PUBLICATIONS

DSP642 Electronic Stabilization Technology of Ink Sub-DSP 642: 59P., Mar. 24, 2014.

*Primary Examiner* — Dong Hui Liang

(57) ABSTRACT

A display device and a controlling method thereof are provided. The display device includes a display panel, a backlight unit, and a time schedule controller. The display panel is configured to display images. Areas where afterimages of dynamic images occur are identified according to comparison results of dither values. Tailing phenomenon of the dynamic images may be relieved by transmitting backlight data without brightness to a second backlight sub-area corresponding to where the afterimages occur. Furthermore, because frequency multiplication is not applied, risks of display instability will not increase.

18 Claims, 3 Drawing Sheets

(58) Field of Classification Search
CPC ..... G09G 2320/0271; G09G 2320/043; G09G 2320/0626; G09G 2320/0693; G09G 2320/0633; G09G 2320/0257; G09G 3/3406; G09G 3/3607; G09G 3/0648; G09G 3/3426; G09G 3/2044; G09G 3/2051; G09G 2360/145; G09G 2360/16; G09G 2300/0443; G09G 2310/0205; G09G 2370/08
See application file for complete search history.

(56) References Cited

U.S. PATENT DOCUMENTS

| | | | |
|---|---|---|---|
| 2013/0342434 | A1 | 12/2013 | Chen et al. |
| 2015/0062203 | A1 | 3/2015 | Sun et al. |

FOREIGN PATENT DOCUMENTS

| | | |
|---|---|---|
| CN | 101609658 | 12/2009 |
| CN | 101673521 | 3/2010 |
| CN | 102279482 | 12/2011 |
| CN | 105047144 | 11/2015 |
| CN | 106205497 | 12/2016 |
| CN | 109166553 | 1/2019 |
| CN | 109949751 | 6/2019 |
| CN | 110114818 | 8/2019 |
| CN | 110473504 | 11/2019 |
| CN | 111091788 | 5/2020 |
| CN | 103489420 | 4/2021 |
| KR | 10-2009-0056052 | 6/2009 |

* cited by examiner

DISPLAY DEVICE AND CONTROLLING METHOD THEREOF

RELATED APPLICATIONS

This application is a National Phase of PCT Patent Application No. PCT/CN2020/129940 having International filing date of Nov. 19, 2020, which claims the benefit of priority of Chinese Patent Application No. 202011091112.4 filed on Oct. 13, 2020. The contents of the above applications are all incorporated by reference as if fully set forth herein in their entirety.

FIELD AND BACKGROUND OF THE INVENTION

The present disclosure relates to the field of display technologies, and more particularly, relates to the field of liquid crystal display technologies. Specifically, the present disclosure relates to a display device and a controlling method thereof.

Micro light-emitting diode (micro-LED) display devices have been developed to become one of promising future display technologies. Compared with current display devices, e.g., liquid crystal display (LCD) devices and organic light-emitting diode (OLED) display devices, the micro-LED display devices have multiple merits such as fast response times, wide color gamut, high pixels per inch (PPI), and low power consumption. However, technologies of micro-LEDs, especially key technologies thereof, e.g. mass transfer technologies and miniaturization of crystal grains, are difficult and complicated. As a combination of the micro-LED and a backplate, mini-LEDs have high contrast and great color performance, allowing the mini-LEDs to rival OLEDs. Furthermore, costs of the mini-LEDs are slightly higher than LCDs, but are only 60% that of OLEDs. Compared with micro-LEDs and OLEDs, the mini-LEDs are easier to be implemented. Therefore, the mini-LEDs have become a market strategy of panel manufacturers.

When high-speed dynamic pictures are displayed by conventional technical devices, afterimages occur not only because of response times of liquid crystals but also because of human's visual properties. Nowadays, display in different areas is generally realized by frequency multiplication to improve afterimages of dynamic pictures. However, the above method significantly reduces scan period of backlight, making display systems unstable.

The present disclosure provides a display device and a controlling method thereof to solve following problems: when dynamic pictures are displayed, afterimages may occur and display systems may be unstable.

SUMMARY OF THE INVENTION

In a first aspect, the present disclosure provides a display device including a display panel, a backlight unit, and a time schedule controller. The display panel is configured to display images, the back light unit corresponds to the display panel and is configured to control brightness in different backlight partition areas according to backlight data, and the time schedule controller is connected to the display panel and the backlight unit and is configured to output the corresponding backlight data according to a plurality of dither values sampled from a plurality of points on the images. The backlight partition areas include a first backlight sub-area with corresponding brightness and a second backlight sub-area without brightness, and the second backlight sub-area corresponds to images with the dither values greater than or equal to a dither threshold value.

In a first embodiment of the first aspect, the time schedule controller outputs the backlight data with corresponding brightness to the second backlight sub-area after delay time.

In a second embodiment of the first aspect, the delay time is greater than or equal to 30 μs, and is less than or equal to 3 μs.

In a third embodiment of the first aspect, the backlight data is brightness controlling data and is a bit with N digits, and N is a positive integer.

In a fourth embodiment of the first aspect based on the third embodiment, a number of the backlight partition areas is $2^M$, and M is less than N and is a positive integer.

In a fifth embodiment of the first aspect based on the fourth embodiment, a brightness of at least one of the backlight partition areas refreshes $2^{N-M}$ times per unit time.

In a sixth embodiment of the first aspect based on the fifth embodiment, N is greater than or equal to three times of M.

In a seventh embodiment of the first aspect, the backlight unit includes a plurality of rows of luminescent devices, and each of the backlight partition areas includes at least one row of the luminescent devices.

In an eighth embodiment of the first aspect, the backlight unit includes a plurality of mini light-emitting diodes arranged in an array manner and a backlight driving circuit configured to drive the mini light-emitting diodes.

In a second aspect, the present disclosure provides a method of controlling a display device, including following steps: displaying images by a display panel; obtaining a plurality of dither values sampled from a plurality of points on the images by a dither test unit; and outputting corresponding backlight data to different backlight partition areas in a backlight unit by a time schedule controller according to comparison results between the dither values and a dither threshold value. The backlight partition areas are divided into a first backlight sub-area with a corresponding brightness and a second backlight sub-area without brightness, and the second backlight sub-area corresponds to images with the dither values greater than or equal to a dither threshold value. The time schedule controller outputs the backlight data with a corresponding brightness to the second backlight sub-area after delay time.

Regarding the beneficial effects: the present disclosure provides a display device and a controlling method thereof. Areas where afterimages of dynamic pictures occur are identified according to comparison results of dither values. A tailing phenomenon of dynamic images may be relieved by transmitting backlight data without brightness to a second backlight sub-area corresponding to where the afterimages occur. Furthermore, because frequency multiplication is not applied, risks of display instability will not increase.

DESCRIPTION OF SPECIFIC EMBODIMENTS OF THE INVENTION

Embodiments are further described below in detail with reference to accompanying drawings to make objectives, technical solutions, and effects of the present disclosure clearer and more precise. It should be noted that described embodiments are merely used to construct the present disclosure and are not intended to limit the present disclosure.

Figure 1:
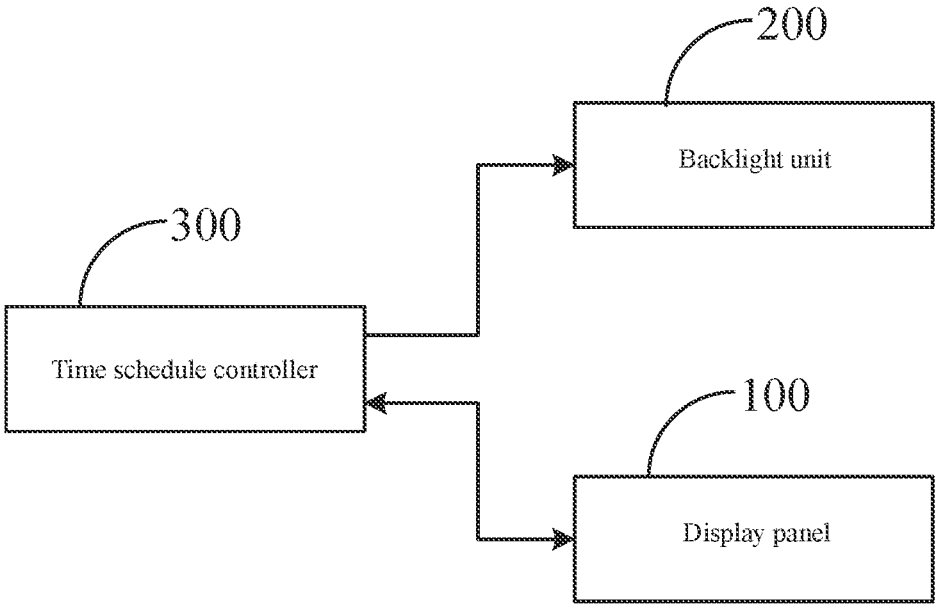
FIG. 1 is a structural schematic view showing a display device according to an embodiment of the present disclosure.
Figure 2:
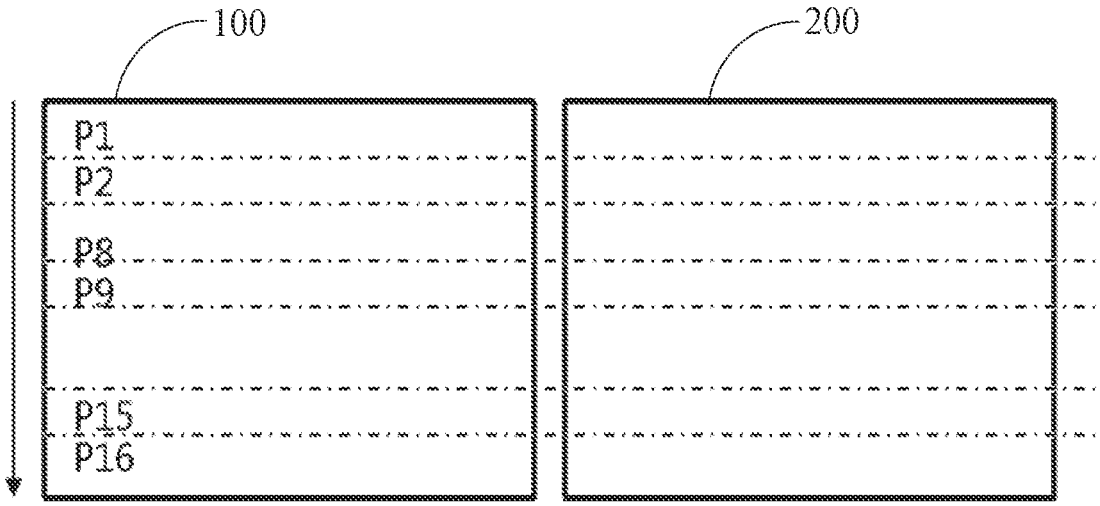
FIG. 2 is a structural schematic view showing a corresponding relationship between the display panel and a backlight unit in FIG. 1.
Figure 3:
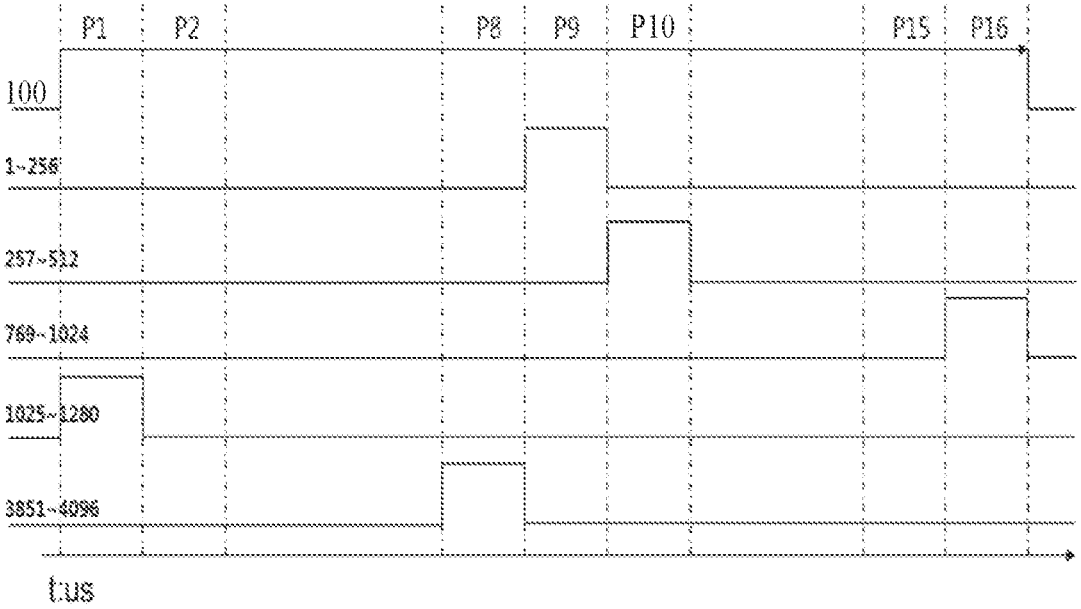
FIG. 3 is a sequence diagram when the display device works according to an embodiment of the present disclosure.

As shown in FIG. 1 to FIG. 3, the present disclosure provides a display device including a display panel 100, a backlight unit 200, and a time schedule controller 300. The display panel 100 is configured to display images, the back light unit 200 corresponds to the display panel 100 and is configured to control brightness in different backlight partition areas according to backlight data, and the time schedule controller 300 is connected to the display panel 100 and the backlight unit 200 and is configured to output the corresponding backlight data according to a plurality of dither values sampled from a plurality of points on the images. The backlight partition areas include a first backlight sub-area with corresponding brightness and a second backlight sub-area without brightness, and the second backlight sub-area corresponds to images with the dither values greater than or equal to a dither threshold value.

It should be noted that the backlight unit 200 at least includes a plurality of mini light-emitting diodes (mini-LEDs) arranged in an array manner and a backlight driving circuit configured to drive the mini-LEDs. Each of the backlight partition areas includes at least one row of the mini-LEDs. The backlight driving circuit may at least individually turn on/off each row of the mini-LEDs and control a brightness of each row of the mini-LEDs. It should be noted that each row of the mini-LEDs corresponds to at least one row of pixels on the display panel 100. It should be noted that a dither threshold value is an empirical data value determined by directly observing a dither test unit/device. The dither threshold value may be calculated or estimated by other empirical data values in an industry, and is not described here. The time schedule controller 300 may perform a dither test on video data of the display panel 100 transmitted from the time schedule controller 300 by an embedded dither test unit, thereby calculating dither values sampled from multiple points on images. Specifically, image shaking happens along with an entire frame displacement. After the frame displacement is detected, image shaking will be sequentially detected according to a logical decision. Typically, detection of dynamic image shaking is relevant to detection of frame displacement.

Common methods to estimate a displacement include an optical flow method, a block matching method, a feature point matching method, and a gray projection method. In actual processes, a corner detection and a sparse optical flow are used in the optical flow method. In actual applications, an application of the optical flow method depends on whether feature points can be easily found. If there are not enough feature points in the environment, an estimated displacement will not be very precise. However, more accurate results require a greater amount of calculation. In addition, a wrong estimation easily occurs when the optical flow method is applied to dynamic objects in practical processes, affecting robustness.

Similarly, an application of the feature point matching method depends on whether feature points can be easily found. Also, finding accurate feature points require a great amount of calculation, leading to relatively low operating speed.

The gray projection method is used more commonly and requires a relatively small amount of calculation. The gray projection method is simplifying and obtaining feature points on images. Pixels are arranged in a two-dimensional manner with rows and columns, and the feature points on images are converted into curved lines extending along a row axis and a column axis, thereby easily calculating distributions of feature points.

It should be understood that the dither values obtained in the present embodiment may roughly reflect an area where tailing phenomenon of dynamic images occurs to a certain degree. A place where afterimages of dynamic pictures occur is identified according to comparison results of dither values. The tailing phenomenon of dynamic images may be relieved by transmitting backlight data without brightness to a second backlight sub-area corresponding to where the afterimages of dynamic images occur. Furthermore, because frequency multiplication is not applied, risks of display instability will not increase.

In one embodiment, displayed images may be monitored by a dither test device. Dither values of sampled points on the displayed images are transmitted to the time schedule device 300 that compares the dither values of the sampled points with a dither threshold value. Then, corresponding backlight data is outputted according to including results, thereby turning on/off of each of the backlight partition areas, and controlling brightness of each of the backlight partition areas. The backlight partition areas may be divided into a first backlight partition sub-area with corresponding brightness and a second backlight partition sub-area without brightness. Furthermore, the second backlight partition area corresponds to images with dither values greater than or equal to the dither threshold value, and the first backlight partition area corresponds to images with dither values less than the dither threshold value. The time schedule controller 300 outputs the backlight data with corresponding brightness to the second backlight sub-area after delay time.

It should be understood that the second backlight partition area remains unluminescent for a certain period. However, it does not mean that the second backlight partition is always unluminescent. On the contrary, it just means that areas where relatively serious tailing phenomenon occurs have an unluminescent period (delay time). Therefore, tailing phenomenon of dynamic images may be relieved. Moreover, frequency multiplication is not necessary to be applied to the display device, and risks of display instability may be effectively reduced.

In one embodiment, the delay time may be greater than or equal to 30 μs, and less than or equal to 3 μs, but is not limited thereto. The delay time may also be 10 μs, 20 μs, or 1 μs. In the present embodiment, if the above range of delay time is applied, the areas where tailing phenomenon occurs will not remain luminescent too long, and relatively better displayed images may be realized.

In one embodiment, the backlight data is brightness controlling data and is a bit with N digits, and N is a positive integer. It should be understood that the greater the N is, the more grayscales may be realized.

In one embodiment, a number of the backlight partition areas is $2^M$, and M is less than N and is a positive integer. It should be noted that more backlight partition areas may realize precise control of backlight partition areas, which is beneficial for relieving tailing phenomenon of dynamic images.

In one embodiment, a brightness of at least one of the backlight partition areas refreshes $2^{N-M}$ times per unit time. It should be understood that each of the bright refreshing times corresponds to one backlight data. In addition, a corresponding backlight brightness gradually increases following increase of the brightness refreshing times.

As shown in FIG. 2, in one embodiment, N is greater than or equal to three times of M. For example, M may be 4, but is not limited thereto. N may be 12, but is not limited to. When there are sixteen backlight partition areas, correspondingly, the backlight partition areas may be respectively marked as P1 to P16. A sub-frame refreshes $2^N$ times (4096 times). Each of the backlight partition areas needs to refresh 256 times. Refreshing 4096 times corresponds to 4000 nit brightness, and refreshing 256 times corresponds to 250 nit brightness.

As shown in FIG. 2 and FIG. 3, in one embodiment, when the display panel 100 displays images for time t, a backlight partition area P1 refreshes 1025 to 1280 times, a backlight partition area P8 refreshes 3851 to 4096 times, a backlight partition area P9 refreshes 1 to 256 times, a backlight partition area P10 refreshes 257 to 512 times, and a backlight partition area P16 refreshes 769 to 1024 times. However, a backlight partition area P2 does not refresh, and this is because the backlight partition area P2 belongs to the second backlight sub-area and does not need brightness currently. Correspondingly, backlight partition areas P3 to P7 and P12 to P15 may also belong to the second backlight partition sub-area, but are not limited thereto.

Figure 4:
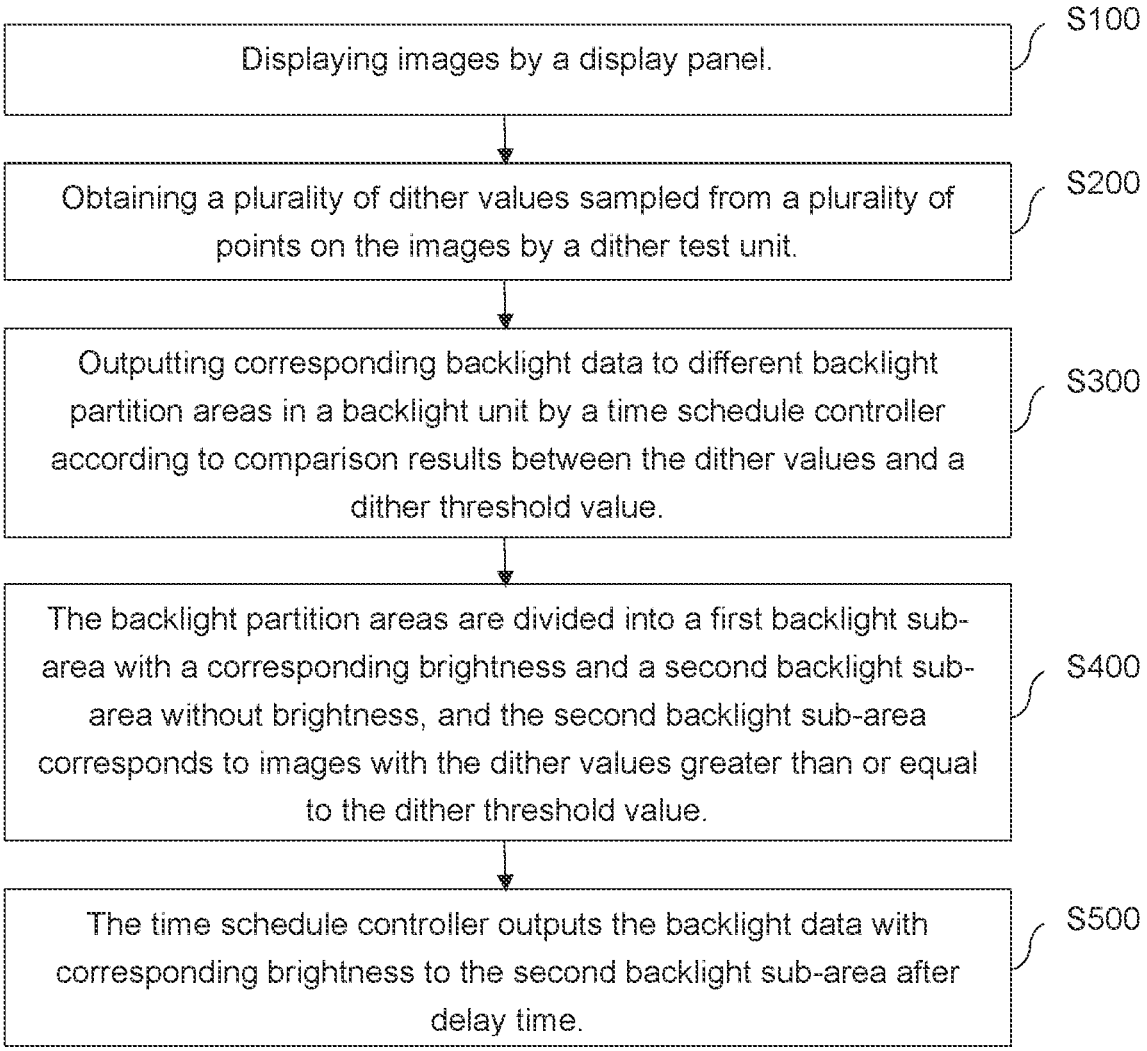
FIG. 4 is a schematic flowchart chart showing a controlling method according to an embodiment of the present disclosure.

As shown in FIG. 4, in one embodiment, the present disclosure provides a method of controlling a display device, including following steps: step 100, displaying images by a display panel 100; step 200, obtaining a plurality of dither values sampled from a plurality of points on the images by a dither test unit; step 300, outputting corresponding backlight data to different backlight partition areas in a backlight unit 200 by a time schedule controller 300 according to comparison results between the dither values and a dither threshold value; step 400, the backlight partition areas are divided into a first backlight sub-area with a corresponding brightness and a second backlight sub-area without brightness, and the second backlight sub-area corresponds to images with the dither values greater than or equal to a dither threshold value; and step 500, the time schedule controller 300 outputs the backlight data with corresponding brightness to the second backlight sub-area after delay time.

It should be understood that order of the above steps is only an example, and the present disclosure is not limited to the above order. The present disclosure provides a display device and a controlling method thereof. A place where afterimages of dynamic pictures occur is identified according to comparison results of dither values. A tailing phenomenon of dynamic images may be relieved by transmitting backlight data without brightness to a second backlight sub-area corresponding to where the afterimages occur. Furthermore, because frequency multiplication is not applied, risks of display instability will not increase.

It should be noted that many changes and modifications to the described embodiment can be carried out by those skilled in the art, and all such changes and modifications are intended to be included within the scope of the appended claims.

What is claimed is:

1. A display device, comprising;

a display panel configured to display images;

a backlight unit corresponding to the display panel and configured to control brightness in different backlight partition areas according to backlight data; and a time schedule controller connected to the display panel and the backlight unit and configured to output corresponding backlight data according to a plurality of dither values sampled from a plurality of points on the images;

wherein the backlight partition areas comprise a first backlight sub-area with corresponding brightness and a second backlight sub-area without brightness, and the second backlight sub-area corresponds to images with the dither values greater than or equal to a dither threshold value.

2. The display device of claim 1, wherein the backlight data is brightness controlling data and is a bit with N digits, and N is a positive integer.

3. The display device of claim 2, wherein a number of the backlight partition areas is 2M, and M is less than N and is a positive integer.

4. The display device of claim 3, wherein a brightness of at least one of the backlight partition areas refreshes $2^{N-M}$ times per unit time.

5. The display device of claim 4, wherein N is greater than or equal to three times of M.

6. The display device of claim 1, wherein the time schedule controller outputs the backlight data with corresponding brightness to the second backlight sub-area after delay time.

7. The display device of claim 6, wherein the delay time is greater than or equal to 30 μs, and is less than or equal to 3 μs.

8. The display device of claim 1, wherein the backlight unit comprises a plurality of rows of luminescent devices, and each of the backlight partition areas comprises at least one row of the luminescent devices.

9. The display device of claim 1, wherein the backlight unit comprises a plurality of mini light-emitting diodes arranged in an array manner and a backlight driving circuit configured to drive the mini light-emitting diodes.

10. A method of controlling a display device, comprising following steps:

displaying images by a display panel;

obtaining a plurality of dither values sampled from a plurality of points on the images by a dither test unit; and outputting corresponding backlight data to different backlight partition areas in a backlight unit by a time schedule controller according to comparison results between the dither values and a dither threshold value;

wherein the backlight partition areas are divided into a first backlight sub-area with corresponding brightness and a second backlight sub-area without brightness, and the second backlight sub-area corresponds to images with the dither values greater than or equal to the dither threshold value.

11. The method of claim 10, wherein the backlight data is brightness controlling data and is a bit with N digits, and N is a positive integer.

12. The method of claim 11, wherein a number of the backlight partition areas is $2^M$, and M is less than N and is a positive integer.

13. The method of claim 12, wherein a brightness of at least one of the backlight partition areas refreshes $2^{N-M}$ times per unit time.

14. The method of claim 13, wherein N is greater than or equal to three times of M.

15. The method of claim 10, wherein the time schedule controller outputs the backlight data with corresponding brightness to the second backlight sub-area after delay time.

16. The method of claim 15, wherein the delay time is greater than or equal to 30 μs, and is less than or equal to 3 μs.

17. The method of claim 10, wherein the backlight unit comprises a plurality of rows of luminescent devices, and each of the backlight partition areas comprises at least one row of the luminescent devices.

18. The method of claim 10, wherein the backlight unit comprises a plurality of mini light-emitting diodes arranged in an array manner and a backlight driving circuit configured to drive the mini light-emitting diodes.

* * * * *